United States Patent [19]

Nielsen

[11] Patent Number: 4,532,025

[45] Date of Patent: Jul. 30, 1985

[54] METHOD OF CONTROLLING CATALYST REGENERATION FOR FLUID CATALYTIC CRACKING TO MINIMIZE CATALYST BACKFLOW ABRASION

[75] Inventor: William C. Nielsen, Novato, Calif.

[73] Assignee: Chevron Research Company, San Francisco, Calif.

[21] Appl. No.: 618,508

[22] Filed: Jun. 8, 1984

[51] Int. Cl.[3] ..... B01J 29/38; C10G 11/18

[52] U.S. Cl. ..... 205/113; 502/41; 208/DIG. 1; 34/54

[58] Field of Search ..... 502/6, 41; 422/62, 111; 208/113, DIG. 1; 34/10, 12, 15, 54

[56] References Cited

U.S. PATENT DOCUMENTS

| | | | |
|---|---|---|---|
| 2,836,902 | 6/1958 | North | 34/57 A |
| 2,855,268 | 10/1958 | Goins et al. | 34/54 |
| 3,135,700 | 6/1964 | Lipuma et al. | 502/41 |
| 3,166,381 | 1/1965 | Loss | 422/62 |
| 3,513,087 | 5/1970 | Smith | 208/DIG. 1 |
| 3,689,403 | 9/1972 | Long | 422/111 |
| 3,707,463 | 12/1972 | Harter et al. | 208/DIG. 1 |
| 3,769,203 | 10/1973 | Lee et al. | 422/111 |
| 3,829,983 | 8/1974 | White | 34/57 A |
| 4,159,239 | 6/1979 | Schwartz | 208/113 |
| 4,354,957 | 10/1982 | Swindell et al. | 208/113 |

*Primary Examiner*—D. E. Gantz
*Assistant Examiner*—Lance Johnson
*Attorney, Agent, or Firm*—Burns, Doane, Swecker & Mathis

[57] ABSTRACT

Spent catalyst is continuously regenerated in a fluid catalytic cracking system by forcing air to flow through such a catalyst bed to burn carbonaceous material from it and to heat such catalyst for fluid catalytic contact with a hydrocarbon feed stream in a reactor transfer line or riser.

The combustion of carbonaceous material is optimized by controlling the rate of air flow through the bed, supported on an open grid having openings which are substantially larger than the average diameter of the catalyst particles. This assures even air flow throughout the bed. Such air flow is optimized by collecting catalyst that may backflow under low flow conditions from below one of the lowest grid openings. The particles are withdrawn from a collector in a minor portion of the air flowing to the catalyst bed. The presence of catalyst is detected either by direct observation or by temperature measurement. The flow rate of air to the regenerator is adjusted to maintain a desired regeneration rate to minimize or prevent backflow of catalyst particles through said grid openings but without excess air flow which would cool the catalyst or require addition of torch oil to achieve a given heat content of the catalyst to be reacted in the process, or cause overloading of the exhaust gas cyclones by catalyst particles or fines.

8 Claims, 4 Drawing Figures

METHOD OF CONTROLLING CATALYST REGENERATION FOR FLUID CATALYTIC CRACKING TO MINIMIZE CATALYST BACKFLOW ABRASION

FIELD OF INVENTION

The present invention relates to fluid catalytic cracking systems. More particularly it relates to a method and apparatus for optimizing flow of an oxygen-containing gas, such as air, through a catalyst regenerator to reactivate and heat spent catalyst for reaction with a hydrocarbon feed in a continuously circulating system and subsequent to separation of the spent catalyst from the resulting reaction products.

It is a particular object of the present invention to provide a system to control burning of residual coke on the spent catalyst in the regenerator to assure optimum combustion of the coke to reactivate and heat the catalyst. Such optimum combustion includes avoiding cooling of the catalyst by excess flow of such oxygen-containing gas, normally air, through the regenerated catalyst. Further, such excess air flow is particularly deleterious to efficient combustion where the FCC system operates at a substantially lower rate than design-capacity or during plant start up. This is particularly important because heat absorbed by the catalyst particles in the regeneration process provide substantially all driving energy for the fluid catalytic cracking system. Such heated catalyst causes rapid evolution of hydrocarbon vapors from a liquid hydrocarbon stream in the reactor riser, or transfer line, and this action produces the primary circulating force for the catalyst in continuous fluid catalytic cracking. Further, conserving such heat improves the overall efficiency of the cracking process and the energy consumed in operating the cracking system.

Air supplied for coke combustion also partially supports the catalyst as a levitated bed on a support grid and assists circulation of the regenerated catalyst from the regenerator combustion bed to the riser reactor. Such air support of the catalyst on the grid is especially important at reduced feed rates where air flow must also be reduced. In accordance with the invention, a portion of such air supplied to the regenerator is withdrawn from the air supply or plenum at a point directly below the support grid. Preferably such air withdrawal is from below the lowest portion of the grid so that any catalyst particle that backflow through the grid into the air chamber may be readily detected. The presence of such particles indicates need to raise the air pressure in the supply line and plenum to increase air flow but without increasing such flow sufficiently to excessively cool the regenerated catalyst, or overload the exhaust cyclones or particles precipitator, thereby decreasing the desired circulation driving force and wasting energy.

BACKGROUND OF THE INVENTION

In regeneration of fluid catalytic cracking catalyst of the type used in modern conversion systems such catalyst is typically a combination of amorphous materials together with crystalline materials such as molecular sieves. Predominant components of such cracking catalysts are silica and alumina in a weight ratio of from about 10 to 60% alumina in the silica. Because alumina is aluminum oxide it is a highly abrasive material. Further, it is particularly abrasive because of its size. In such systems the catalyst normally has a particle size distribution of about 60–90 weight % in the range of 10–120 microns. Such dimensions are on the order of a finely ground flour or talcum powder. The particles flow and respond in a dry state very similar to a liquid.

After catalyst has been used to catalytically crack a hydrocarbon stream, the spent catalyst is coated with coke, primarily heavy hydrocarbon materials and carbon. This material is burned from the spent catalyst both to regenerate and heat it. The added heat is the primary driving energy required to crack the hydrocarbonaceous fluid and to circulate the catalyst. Depending upon the quality of the hydrocarbon feed stream, the catalyst is heated as high as it is reasonably economic to do so. The heated and regenerated catalyst generally flows by gravity from the regeneration bed to the riser reactor. Sufficient inert gas, such as steam, may be added to assist upward flow into a riser reactor. There the hot catalyst contacts a hydrocarbon stream. The actual driving force for the system is the voluminous evolution of hydrocracked gases upon hydrocarbon contact with the hot catalyst. The evolved gases are recovered as product vapors in a separator and the spent catalyst, with coke formed thereon, is returned to the regenerator, primarily by gravity, through a spent catalyst stripper.

In the regenerator the material is deposited on a grid and forms a bed through which air or other oxygen-containing gas is normally pumped under pressure to sustain the burning operation. The rate of flow of air through the bed is critical in that the air pressure also counterbalances the "hydrostatic" head of the "fluid" catalyst bed as it rests on the grid. The pressure through the air flow openings in the grid, either holes or screen, is maintained adequate to prevent catalyst from flowing back into the air supply, or a plenum chamber, normally formed below the bed, for equal distribution of air to catalyst over the entire grid.

Excess air flow through the regenerating catalyst can result in catalyst loss in the combustion gases; this results in overloading of the separating cyclones through which the combustion gases flow or the precipitator system for particles in the stack gases. More critically, excess air flow can decrease the temperature of the regenerated catalyst for reaction with hydrocarbons. Conversely, if air flow is inadequate, the particles will backflow into the air plenum chamber. Under this condition, such particles become mixed with air in the plenum and then re-enter the bed at high velocity through the same or other holes subjecting the air holes or openings to erosion. Such high velocity erosion can substantially increase the size of such airflow holes (either drilled in a plate or formed in a screen). If such holes or openings become too large it is difficult to maintain the plenum pressure high enough to counterbalance the hydraulic head of the catalyst bed. Under such circumstances, an FCC operation must be terminated and the grid repaired or replaced.

In accordance with the present invention, I have found that such problems of maintaining adequate air flow to regenerate the catalyst, but without excessive catalyst cooling or without catalyst backflow from the bed may be controlled by withdrawing a portion of the air in the regenerator plenum from directly adjacent a low point of the bed on the grid. The air withdrawn from the regenerator plenum may be either periodically sampled for catalyst particles by direct inspection or by measurement either directly or indirectly.

In one form of the invention such measurement may be made by directing the sampling air flow stream to the stack gas precipitator for the regenerator. The presence of catalyst particles in the stream may then be detected either by periodically sampling the air for particles or by measuring the temperature of gas flowing in the sample stream which would be elevated by the presence of hot catalyst therein. The rate of flow of the oxygen-containing gas to the plenum chamber, is then adjusted so that the plenum pressure is above that at which catalyst will backflow so that it can be detected in the sample stream.

In establishing such a level of air flow, the flow may first be reduced so that some catalyst is entrapped in the withdrawn air stream. Such catalyst is directly indicated by the presence of the particles or indirectly by measuring a temperature rise of the air stream. The flow is then raised by, say 10 percent, to assure no catalyst backflow. During continuous operation of the fluid catalytic system the backflow is then periodically checked to assure that the pressure required to maintain balance between the plenum air pressure and the head of fluid-like catalyst resting on the grid is adequate to prevent detection of hot particles in the sampled, or withdrawn, air stream.

SUMMARY OF THE INVENTION

It is an object of the present invention to improve operation of a fluid catalytic cracking system, and in particular the regeneration of spent catalyst, by controlling the rate of air flow through a bed of such catalyst to burn carbonaceous material from it. Such burning thereby heats and regenerates such catalyst so that upon contact with a hydrocarbon feed stream in a reactor, optimum catalytic cracking will result. Such combustion is optimized in accordance with the present invention by controlling the rate of air flow through the bed which is supported upon a grid having openings therein that are substantially larger than the average diameter of the catalyst particles arresting on it. Such openings are sufficiently large so that flow of air through the bed is evenly distributed and the bed is held in hydrostatic balance, or partially levitated, against the hydraulic pressure of the "head" of fluid catalyst. This permits the regenerated catalyst, having a lower density than the coke-laden spent catalyst, to rise by gravity in the bed and overflow into the intake of the return line to the reactor riser. In accordance with the present invention the rate of air flow through the bed is controlled so that adequate burning of coke from, and heating of, the catalyst occurs without flow of excess air which tends to cool the regenerated catalyst before it returns to the reactor riser, or to overload the combustion gas cyclones. At the same time the rate of such flow is also controlled to prevent backflow of catalyst through the grid openings which abrade and enlarge the openings due to the abrasive character of the catalyst particle, normally alumina, upon subsequent mixture and injection of the backflowing catalyst in the high velocity air flowing through the same or other openings. In accordance with the present invention such catalyst backflow or excessive air flow through the grid is controlled by positioning a catalyst particle collector adjacent the lowest portion of bed on the grid and hence the location of the highest hydrostatic pressure of the catalyst particles due to gravity.

In such control a sample portion of the plenum air is withdrawn through the collector so that any catalyst particles captured therein are entrained in the sampled air. In a preferred method of carrying out the invention the airflow sample is withdrawn periodically or intermittently to detect catalyst therein. The catalyst may either be detected directly by observation or may be detected by instrument as by any form of physical characteristic measuring device such as a radiation detector, a thermistor or the like. In an alternative embodiment the method may be carried out by flowing a low-volume continuous stream of air from the regenerator air plenum through the collector and then flowing the stream in parallel with the stack or effluent gases to any lower pressure portion of the regenerator exhaust gas system. Preferably such flow is to a precipitator for removing solid pollutants, or catalyst particles, from the stack gas. The flow of catalyst particles in the air stream may then be detected directly by sampling the continuously flowing stream or by remote detection through measurement of the physical characteristic of the stream. Temperature or the presence of the particles may be indicated by any suitable detector. In the preferred embodiment, combustion of carbon particles on the spent catalyst regeneration is by compressed air. Alternatively, regeneration may be carried out by flowing a known quantity of oxygen in an inert gas, or other gas partially depleted of oxygen, such as recirculated stack gas.

In a preferred form of apparatus for carrying out the method of the present invention the grid support for the regenerating catalyst bed is in the form of a concave plate and the catalyst collector is positioned below openings or air holes at the lowest point, generally the center, of the concave plate. Alternatively, the grid support may be in the form of a convex support wherein the center of the bed is higher than the surrounding edges. In such an embodiment the air sample stream is drawn through a collector trough positioned around the outer edge of the vessel so that the collector is at the lowest point of the bed of regenerating catalyst. Where the bed is supported by a relatively flat grid, a small depression or sump may be formed in the grid to provide a low point where the hydrostatic head of the regenerating catalyst will be greater than in the rest of the bed. Such air sample is then drawn from a collector positioned below the catalyst sump. Air flow to the regenerator plenum and through the grid may be controlled in response to the presence of catalyst particles in the sampling air stream withdrawn from the vessel through the catalyst collector.

Further objects and advantages of the present invention will become apparent through the following detailed description, taken in conjunction with the accompanying drawings which form an integral part of the present specification.

IN THE DRAWINGS

FIG. 1 is a schematic, elevation view, partially in section, of a fluid catalytic cracking system to which the present invention has been applied and particularly illustrates a catalyst regenerator backflow sampling arrangement for either intermittent or continuous detection of such particles in a portion of the air stream withdrawn from a collector in the regenerator plenum which is positioned directly below the lowest portion of the grid support for a bed of regenerating catalyst.

DESCRIPTION OF THE PREFERRED EMBODIMENT

Figure 1:
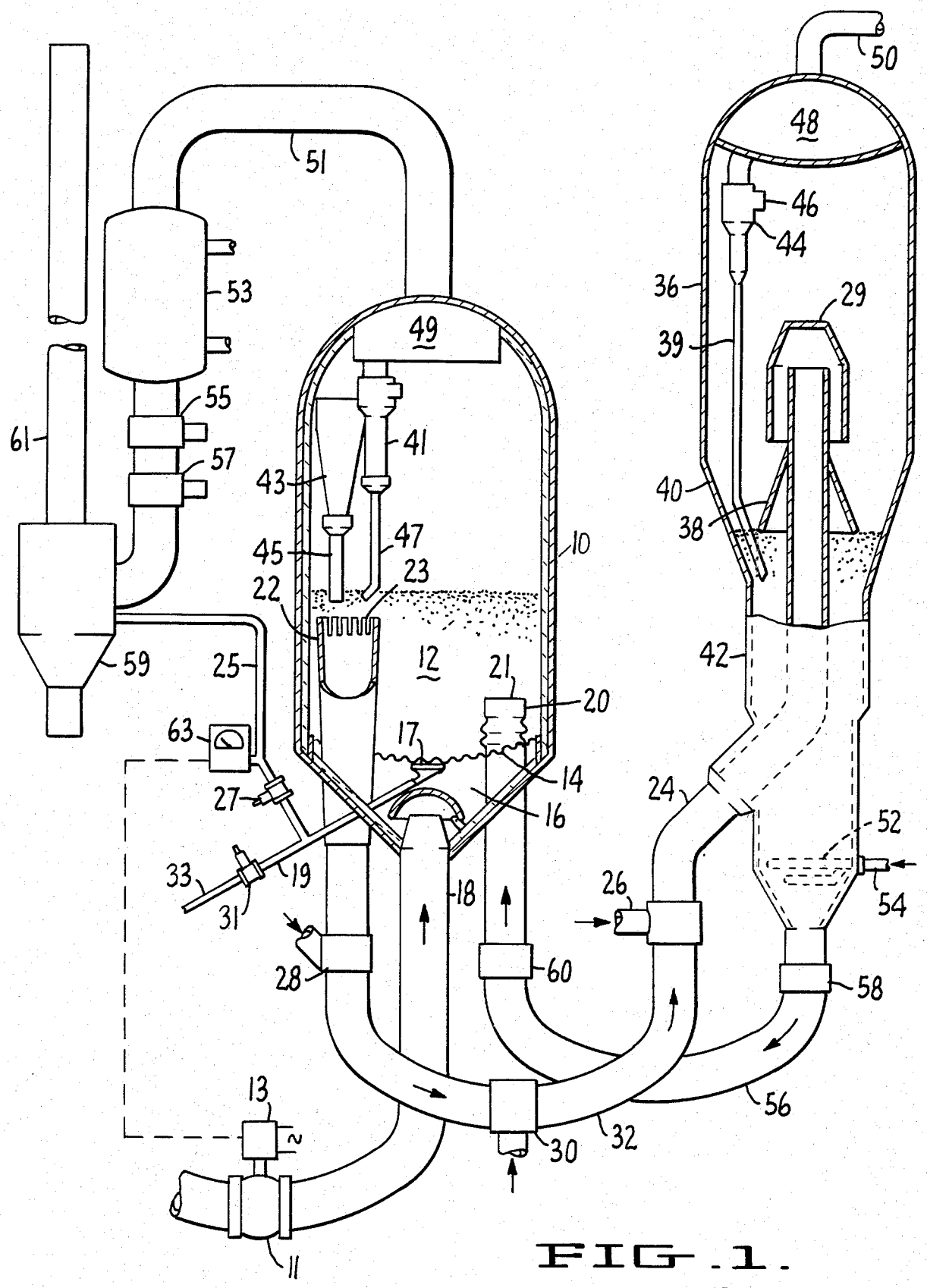
Figure 2:
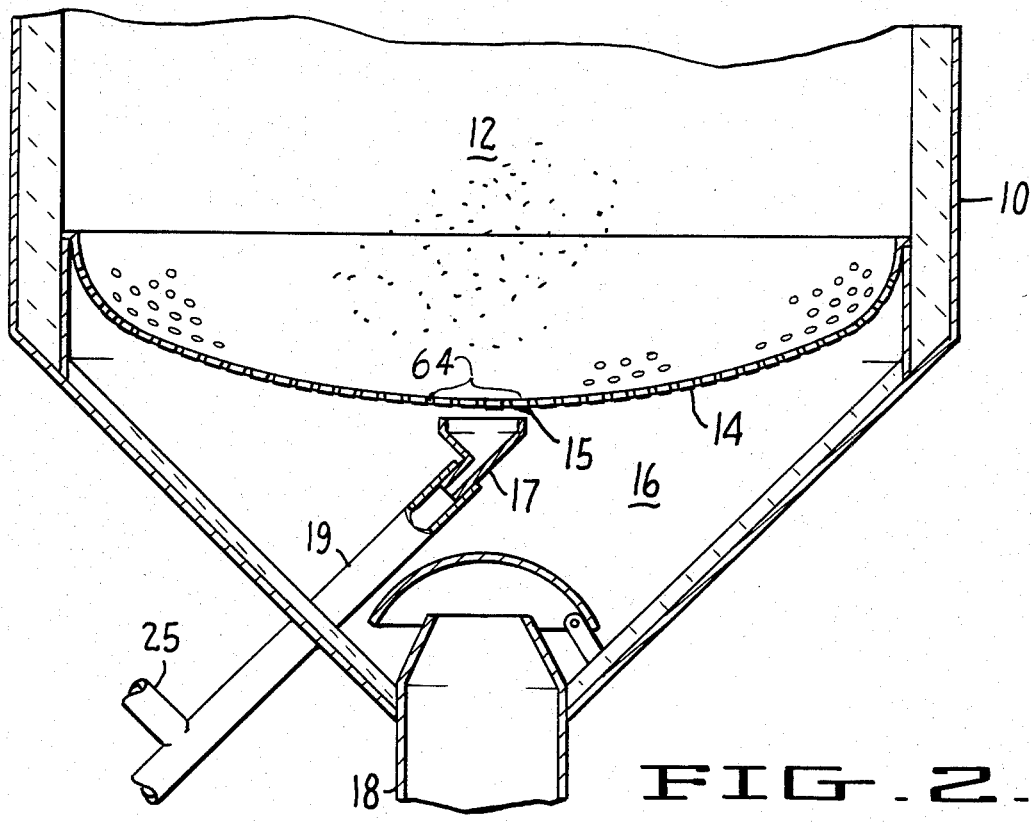
FIG. 2 is an enlarged cross-sectional view through the lower portion of the regenerator illustrated in FIG. 1, showing in greater detail the concave grid support for a catalyst bed and indicating a preferred form of collector for removing catalyst particles that may drop through the air holes.

Referring now to the drawings and in particular to FIGS. 1 and 2, the present invention is shown as applied to a fluid catalytic cracking system wherein regenerator 10 supports a bed of catalyst 12 which has previously been reacted with a stream of fluid hydrocarbons. In the present embodiment the catalyst bed 12 is supported upon a grid 14 formed as a generally dished or concave plate having a multiplicity of uniformly spaced air holes 15 drilled or formed in it. Oxygen containing gas, such as air, is supplied to plenum 16 below grid 14 under pressure from inlet line 18. Combustion gas, preferably air, is introduced from a compressor (not shown) through a throttle valve 11 which may be driven by motor 13 to set a given flow rate. Spent catalyst is deposited in bed 12 by overflow from spent catalyst return line 20. Inlet 21 of line 20 is relatively low in bed 12 so that the most heavily contaminated or coke-laden catalyst settles by gravity to the bottom of bed 12 and catalyst being stripped or regenerated rises in the bed as the coke is burned off. Such burning adequately heats the catalyst so that it is prepared to carry out the required catalytic reaction upon contact with a stream of fluid hydrocarbon. The stripped catalyst overflows from the top of bed 12 into intake 23 of return line 22.

Figure 3:
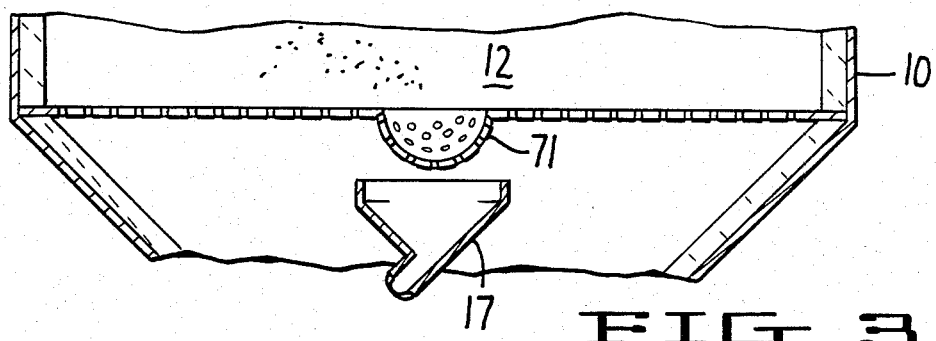
FIG. 3 is view similar to FIG. 2 showing a modified form of a catalyst support grid in accordance with the present invention as applied to a grid having a relatively flat base and a catch basin or sump formed in the base to permit sampling of catalyst particles.
Figure 4:
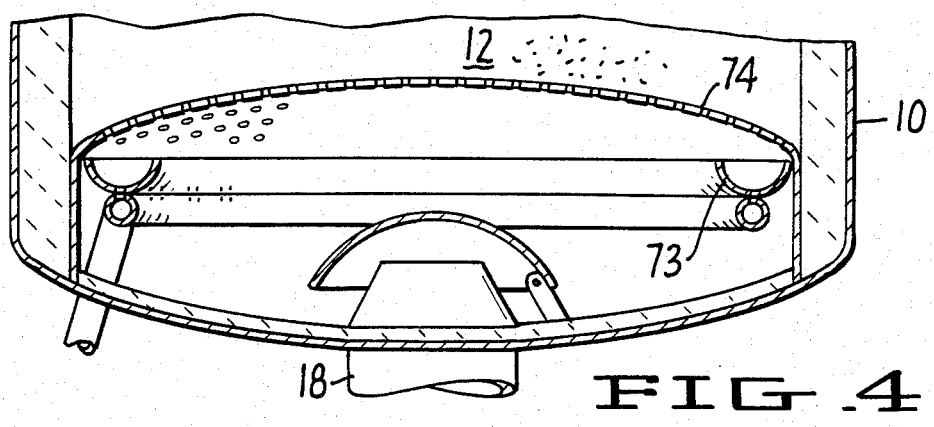
FIG. 4 illustrates another embodiment of a catalyst grid of FIGS. 1 and 2 wherein the grid support for the catalyst bed is convex relative to the bottom of the catalyst bed and collector is in the form of annular trough.

As indicated above, the flow characteristics of catalyst formed with a particle size distribution of from 10–120 microns, are such that the catalyst acts as a "fluid". In such a conventional system for such catalyst regeneration, the weight of the "fluid body" as represented by bed 12 is counterbalanced by the air pressure in plenum 16 so that lighter particles which have been stripped of coke tend to rise or float in the bed. Normally the pressure in plenum 16 is maintained above about 20 psig and so that backflow of catalyst will not fall through holes 15 in the grid 14. As indicated in FIGS. 2 to 4, holes 15 have a diameter or opening size of from about ¾ to one inch, which is from 200 to 1000 times the diameter of catalyst particles supported thereon. While an open screen may be used instead of spaced apart holes 15, in general, the mesh size of such a screen will have openings considerably larger than the average catalyst diameter. As noted before, a particular problem arises when the flow rate of air through catalyst bed 12 is too high. Specifically, the catalyst while being adequately regenerated may in fact be cooled so that catalyst overflowing into inlet 23 of line 22 from the top of bed 12 is cooler than desirable for reaction of catalyst with the hydrocarbon feed stream. Furthermore, the thermal energy thereby lost in the effluent gas from the regenerator degrades the thermal efficiency of the process. As well understood in the art of fluid catalytic cracking, the primary driving force for flow of catalyst to reactor riser 24 for contact with hydrocarbon fluid entering through line 26 is provided by the evolution of hydrocarbon gas, namely, the reactant gases produced upon such contact of heated catalyst with the hydrocarbon. In the present embodiment catalyst is assisted in moving from inlet 23 in regenerator 10 to reactor riser 24 through U-tube 32 by steam or other inert gas introduced, as indicated schematically through spaced apart nozzle arrangements 28 and 30.

The resulting vapor and catalyst mixture in the reaction is separated in vessel 36. In the embodiment of FIG. 1 riser pipe 24 terminates in a shroud 29 which directs the catalyst and vapor downwardly so that catalyst is separated as it passes downwardly and outwardly over cone 38. Product vapors from such reaction rise in vessel 36 and are recovered through intake 46 of cyclone 44. Product recovered through cyclone 44 pass through vapor recovery plenum 48 and is carried by line 50 to a distillation column (not shown) for separation into desired higher hydrocarbon fractions, such as gasoline, gas oil and the like. Catalyst leaving shroud 29 passes downwardly over cone 38 and is collected in the lower portion of conical wall 40 of vessel 36. Particles separated from product vapor in cyclone 44 is also returned to this portion of vessel 36 through dip legs 39. Recovered catalyst is then stripped of residual hydrocarbon vapor in stripper section 42. Preferably steam to assist such stripping is supplied by nozzle assembly 52 by line 54. Coke-enriched spent catalyst then returns to regenerator 10 from stripper 42 through leg 20 of U-tube 56. Because the elevation of catalyst in separator vessel 36 is usually higher than bed 12, such flow is primarily by gravity. However, such gravity flow may be assisted by air or inert gas supplied to U-tube 56 through nozzle rings 58 and 60.

It will be understood, of course, that the riser and separation system shown in FIG. 1 are only exemplary of many mechanical arrangements of fluid catalytic cracking systems. It will also be understood that the reaction of hydrocarbon streams containing heavy cycle oils or residua are cracked by fresh or regenerated catalyst supplied to reactor riser 24 at temperatures of from about 1100° F. to 1400° F., or higher. Accordingly, it is most desirable to heat the catalyst to such temperatures and retain such high temperature before returning it to intake 23 of line 22, but without backflow of catalyst through the support grid. On the other hand, if the hydrocarbon stream includes predominantly heavier components, a cooler range of catalyst temperatures is desirable to prevent over-coking of catalyst during reaction.

In either case, a particular problem created by backflow of catalyst through the grid is that such particles are normally formed of aluminum oxide, a highly abrasive material. Flow of this material through holes 15 or openings in steel grid 14 can be highly destructive of the original size of these holes, which although relatively large, say ¾ to 1 inch in diameter, are normally designed to support catalyst particles of conventional size. As noted above this is on the order of 10 to 120 microns in diameter. When catalyst is permitted to backflow through the lower holes of grid 14, erosion of the higher air supply holes occurs by mixture of such backflowing catalyst with higher velocity compressed gas, or air, being forced upwardly through other holes 15.

Accordingly, it is highly desirable to control the air flow through grid 14 as closely as possible to promote the desired temperature of the returning catalyst, but without backflow of the catalyst which can erode and seriously damage the support grid. In some cases, such support grids may be sufficiently eroded in certain holes, so that catalyst can only be supported on the grid by inordinantly raising the air pressure in plenum 16.

In accordance with the present invention and as described above, the present invention permits such control of air pressure in plenum 16 and in bed 12 to produce the desired temperature of the regenerated catalyst and the overall thermal efficiency of the process (including reduced need for adding torch oil to bed 12 to maintain a desired temperature) throughout regeneration. At the same time, backflow of the catalyst into the plenum chamber 16 and erosion of holes 15 in grid 14 is prevented.

As particularly illustrated in FIGS. 2 to 4, various arrangements for capturing any catalyst particles backflowing through the grid are contemplated by the present invention. FIG. 2 illustrates an enlarged embodiment of the arrangement of FIG. 1. Grid 14 is formed with a concave shape (as viewed from the catalyst support side). Due to such concave form and the fluid characteristic of the catalyst supported on the grid, the highest hydrostatic pressure is, of course, at center portion 64, which directly overlies collector 17 supported on pipe 19. In its simplest form for carrying out the method of the present invention, a valve 31 in line 19 controls periodic flow of a low volume of air from plenum 16 through collector 17 and outwardly from the vessel to permit capture of any catalyst particles carried in flow line 33. Valve 31 allows the pressure in sample line 19 to be adjusted sufficiently so that the rate of such air flow to convey catalyst particles captured in collector 17 will not substantially upset the pressure in plenum 16. In another embodiment of the method, continuous withdrawal is provided by connecting line 19 to line 25 to form a parallel flow path to the stack gas system for regenerator 10, as described below.

As schematically shown in FIG. 1, exhaust of combustion gases from regenerator 10 is drawn off through cyclones 41 and 43. Catalyst particles separated by these cyclones are returned by dip legs 45 and 47, respectively. The exhaust gas then flows from plenum 49 through exhaust line 51 to a heat recovery unit 53 and then through pressure reducing gate valves 55 and 57 to solids precipitator 59. Final exhaust of waste gas then flows to stack 61. In one form of the present invention, advantage may be taken of the reduced pressure in precipitator 59, generally not more than about 10% to 20% of that in air plenum chamber 16, to create continuous or intermittent flow of sample gas from catalyst collector 17. As indicated, flow in line 25 from line 19 is controlled by valve 27. In this way, a portion of air from plenum 16 may flow to precipitator 59. The presence of catalyst in the flow may then be detected periodically through line 33 by opening valve 31, or the temperature of air flow in line 25 may be measured by a suitable detector, such as a thermistor or a thermocouple. The detector signal may be recorded or indicated, as suggested by meter 63. As indicated by the dash line between meter 63 and valve motor 13, control of air flow may be made responsive to the presence of catalyst particles in the sampling air stream either automatically, as by a computer, or manually.

In carrying out the method of the present invention, various systems for capturing backflow particles from the catalyst bed may be used. FIGS. 3 and 4 illustrate such methods where the grid is generally flat, as in FIG. 3, or convex (relative to the bed) as in FIG. 4.

In FIG. 3, preferably a sump or catch basin 71 may be formed in plate 72 forming the regenerating bed support.

In FIG. 4, an annular collector, or trough, 73 is formed around and below the outer circumference of convex grid 74.

The foregoing apparatus is particularly suitable for carrying out the control of air flow through the regenerating catalyst to optimize both use of the air supply (which is costly for power to drive the blowers) and to recover maximum heat for catalytic cracking (which results in greater profit from product generated). Alternatively, conservation of heat from burning coke on the catalyst reduces cost for torch oil that may otherwise be required to maintain a desired regenerated catalyst temperature.

Various modifications and changes in the method of performing the present invention including its application to similar fluid processes will occur to those skilled in the art from the foregoing description of the preferred embodiments. All such modifications and changes coming within the spirit and scope of the following claims are intended to be included therein.

What is claimed is:

1. In a fluid catalytic cracking process wherein catalyst is continuously regenerated in a regenerator vessel by forcing air flow through a bed of spent catalyst in said vessel to burn carbonaceous material from such catalyst and to heat such catalyst thereby for contact with a hydrocarbon feed stream in a reactor transfer line or riser to cause catalytic cracking of such hydrocarbons, a method for optimizing combustion of said carbonaceous material on said spent catalyst by controlling the rate of air flow through a bed of said catalyst, said bed being supported by a grid having openings therein substantially larger than the average diameter of said catalyst particles to assure even flow throughout said bed, wherein the improvement comprises positioning a catalyst collector below a lower portion of said grid to receive catalyst particles that may fall through said portion of said grid under low air flow conditions, withdrawing a portion of the air flowing to said bed of catalyst through said collector to detect the presence of catalyst therein and adjusting the flow rate of air through said grid to maintain a flow rate thereto adequate to avoid backflow of catalyst particles through said grid openings into said collector.

2. The method of claim 1 wherein said air flow from said collector flows as a stream to the outside of said fluid catalytic cracking flow system and said air flow is at least intermittently sampled for catalyst therein.

3. The method of claim 1 wherein said air flow from said collector flows as a stream in parallel with a stream of combustion gas evolved during regeneration of said spent catalyst flowing to a particle precipitator and a physical characteristic of said air flowing in said stream is measured as an indication of catalyst therein.

4. The method of claim 3 wherein said measured physical characteristic is the temperature of said stream to permit detection of backflow of hot catalyst from said regenerating catalyst bed.

5. The method of claim 3 wherein said physical characteristic is measured by detecting the presence of catalyst particles in said air flow.

6. The method of claim 5 wherein a sample is withdrawn from said parallel stream for detection of said catalyst particles carried therein.

7. In a fluid catalytic cracking process regeneration step wherein spent catalyst is heated by burning residual coke from the surface of the catalyst particles, with or without the addition of torch oil, and whereby said catalyst is regenerated for reaction with fresh hydrocarbon feed in a riser or transfer line reactor, a method of controlling the regenerator air flow to prevent cooling of said catalyst by excess combustion air flow or backflow of catalyst by inadequate air flow through air passages into a bed of catalyst undergoing regeneration wherein the improvement comprises:

during supply of combusion air to the regenerator for flow through said bed of catalyst withdrawing a minor portion of the combustion air through a collector positioned directly below at least some of the lower air passages into said bed of catalyst, measuring a physical characteristic of the withdrawn combustion air as an indication that the rate of air flow to said bed is adequate to prevent backflow and resultant reintroduction of catalyst in said air flow through other of said air passages with attendant abrasion and erosion thereof, and controlling flow of combustion air to said regenerator in accordance with said measured physical characteristic.

8. A method of controlling combustion of carbonaceous material on catalyst particles to heat and reactivate said particles to catalytically crack hydrocarbonaceous material during evolution of a gaseous vapor phase from a hydrocarbonaceous feedstream, said vapor evolution providing a substantial portion of the energy for circulation of said catalyst particles in a fluid catalytic cracking system, which comprises circulating an oxygen-containing gas through a body of catalyst particles having such carbonaceous material thereon, said body of catalyst being gravity supported on a grid having substantially uniform openings formed therein, said openings being substantially larger than the average diameter of said catalyst particles, maintaining the rate of flow of said oxygen-containing gas sufficient to minimize reverse flow of said particles by gravity through said openings, withdrawing a minor portion of the gas supplied to said catalyst bed through a collector positioned below said openings to withdraw any catalyst particles therein, detecting a physical characteristic of said catalyst in said gas and subsequently adjusting the rate of flow of said oxygen-containing gas to said bed in an amount and to an extent to permit heating and reactivating said catalyst without substantial flow of catalyst particles in said minor portion of said gas withdrawn from below said openings.

* * * * *